US009203145B2

(12) United States Patent
Yukimoto et al.

(10) Patent No.: US 9,203,145 B2
(45) Date of Patent: Dec. 1, 2015

(54) ANTENNA-DEVICE SUBSTRATE AND ANTENNA DEVICE

(75) Inventors: Shinsuke Yukimoto, Saitama (JP); Ryo Saito, Saitama (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 182 days.

(21) Appl. No.: 13/993,175

(22) PCT Filed: Dec. 15, 2011

(86) PCT No.: PCT/JP2011/007020

§ 371 (c)(1),
(2), (4) Date: Jun. 11, 2013

(87) PCT Pub. No.: WO2012/090415

PCT Pub. Date: Jul. 5, 2012

(65) Prior Publication Data

US 2013/0265207 A1 Oct. 10, 2013

(30) Foreign Application Priority Data

Dec. 28, 2010 (JP) ..... 2010-293924

(51) Int. Cl.
*H01Q 1/50* (2006.01)
*H01Q 1/24* (2006.01)
(Continued)

(52) U.S. Cl.
CPC ..... *H01Q 1/50* (2013.01); *H01Q 1/243* (2013.01); *H01Q 1/38* (2013.01); *H01Q 5/328* (2015.01); *H01Q 9/42* (2013.01)

(58) Field of Classification Search
CPC ..... H01Q 1/50
USPC ..... 343/860, 850, 700 MS
See application file for complete search history.

(56) References Cited

U.S. PATENT DOCUMENTS 6,642,904 B2 * 11/2003 Yokoshima et al. ..... 343/829
7,098,862 B2 * 8/2006 Regala ..... 343/850
(Continued)

FOREIGN PATENT DOCUMENTS

CN 1926720 A 3/2007
CN 101867086 A 10/2010
(Continued)

OTHER PUBLICATIONS

Chinese Office Action dated Jul. 3, 2014 for Chinese Application No. 201180062692.7.
(Continued)

*Primary Examiner* — Huedung Mancuso
(74) *Attorney, Agent, or Firm* — Locke Lord LLP; Jeffrey D. Hsi

(57) ABSTRACT

Provided are an antenna-device substrate which is capable of flexibly adjusting multiple resonance frequencies and can also be made small and thin and an antenna device provided with the same. The present invention is provided with a substrate main body (2), first to third elements (3 to 5), a ground plane (GND), and a ground connection pattern (6), wherein the first element is provided with a feed point (FP) at the base end and extends while having a power feeding-side passive element (P0), a first connecting portion (C1), and an antenna element (AT); the second element extends while being connected to the first element via a second connecting portion (C2); and the third element extends while being connected to the first element via a third connecting portion (C3). The first element extends while being spaced apart from the second and third elements and the ground plane such that a stray capacitance can be generated between the first element and each of the second and third elements and the ground plane; and at least one of the first to third elements is patterned from the surface to the rear surface of the substrate main body via a through-hole.

17 Claims, 9 Drawing Sheets

(51) Int. Cl.

| | |
|---|---|
| ***H01Q 1/38*** | (2006.01) |
| ***H01Q 9/42*** | (2006.01) |
| ***H01Q 5/328*** | (2015.01) |

(56) References Cited

U.S. PATENT DOCUMENTS

| | | | | |
|---|---|---|---|---|
| 7,423,594 | B2 * | 9/2008 | Yanagi et al. | 343/700 MS |
| 8,294,622 | B2 * | 10/2012 | Amari et al. | 343/702 |
| 2005/0122265 | A1 * | 6/2005 | Gaucher et al. | 343/700 MS |
| 2008/0030420 | A1 * | 2/2008 | Lee et al. | 343/853 |
| 2009/0251380 | A1 * | 10/2009 | Kuramoto et al. | 343/843 |

FOREIGN PATENT DOCUMENTS

| | | | |
|---|---|---|---|
| JP | 2002-158529 | A | 5/2002 |
| JP | 2005020266 | A | 1/2005 |
| WO | WO2005/064743 | | 7/2005 |
| WO | WO-2006134701 | A1 | 12/2006 |
| WO | WO-2010016298 | A1 | 2/2010 |

OTHER PUBLICATIONS

International Search Report of PCT/JP2011/007020.

* cited by examiner

ANTENNA-DEVICE SUBSTRATE AND ANTENNA DEVICE

CROSS-REFERENCE TO RELATED APPLICATIONS

This application is the national phase under 35 U.S.C. §371 of PCT International Application No. PCT/JP2011/007020 filed Dec. 15, 2011, which claims the benefit of Japanese Patent Application No. 2010-293924 filed Dec. 28, 2010, the entire contents of the aforementioned applications are hereby incorporated herein by reference.

BACKGROUND OF THE INVENTION

1. Field of the Invention

The present invention relates to an antenna-device substrate which is capable of supporting multiple resonance frequencies and an antenna device provided with the same.

2. Description of the Related Art

Conventionally, in order to multiple-resonate the resonance frequency of an antenna provided in communication equipment, there has been proposed an antenna including a radiation electrode and a dielectric block or an antenna device using a switch and a controlled voltage source.

For example, as a conventional technique using a dielectric block, Patent Document 1 discloses a high-efficiency composite antenna which is obtained by forming a radiation electrode into a molded resin article and then integrating the molded resin article and a dielectric block with an adhesive.

Also, as a conventional technique using a switch and a controlled voltage source, Patent Document 2 discloses an antenna device including a first radiation electrode, a second radiation electrode, and a switch which is interposed between the middle part of the first radiation electrode and the base end portion of the second radiation electrode and electrically connects or disconnects the second radiation electrode to/from the first radiation electrode.

PRIOR ART DOCUMENTS

Patent Documents

Patent Document 1: Japanese Laid-Open Patent Publication No. 2010-81000

Patent Document 2: Japanese Laid-Open Patent Publication No. 2010-166287

SUMMARY OF THE INVENTION

Problems to be Solved by the Invention

However, the following problems still remain in the conventional techniques described above.

Specifically, in the technique using a dielectric block as disclosed in Patent Document 1, a dielectric block for exciting a radiation electrode is used so that the dielectric block, the radiation electrode pattern, and the like need to be designed for each equipment, resulting in a disadvantage in that antenna performance may be deteriorated depending on the design conditions or the unstable factors may increase. Also, since a radiation electrode is formed on the surface of a molded resin article, a radiation electrode pattern needs to be designed on the molded resin article. Consequently, antenna design and die design are required depending on communication equipment for implementation or its application, resulting in a considerable increase in cost. Furthermore, a dielectric block and a molded resin article are integrated with an adhesive, resulting in deterioration of antenna performance or an undesirable increase in unstable factors depending on adhesion conditions (thickness of adhesive, adhesive area, and the like) other than the Q value of an adhesive.

In the case of an antenna device using a switch and a controlled voltage source as disclosed in Patent Document 2, the resonance frequency is switched by the switch so that the configuration of a controlled voltage source, a reactance circuit, and the like are required, resulting in a complication of the antenna configuration for each equipment, no degree of freedom in design, and a difficulty in readily adjustment of the antenna.

Furthermore, it has been required in recent years to achieve further size reduction and enhanced performance of an antenna device.

The present invention has been made in view of the aforementioned circumstances, and an object of the present invention is to provide an antenna-device substrate and an antenna device which are capable of flexibly adjusting each of resonance frequencies which have been caused to be multi-resonant and are also capable of achieving a size reduction and thinning as well as readily ensuring the antenna performance at low cost depending on its application or each equipment.

Means for Solving the Problems

The present invention adopts the following structure in order to solve the aforementioned problems. Specifically, an antenna-device substrate according to a first aspect of the present invention is characterized in that the antenna-device substrate includes an insulating substrate main body; and a first element, a second element, a third element, a ground plane, and a ground connection pattern each of which is in the form of metal foil and has been patterned on the substrate main body; wherein the first element is provided with a feed point at the base end and extends while having a power feeding-side passive element, a first connecting portion to which a first passive element is connectable, and an antenna element of a dielectric antenna in this order at the intermediate portion, the second element extends such that the base end thereof is connected via a second connecting portion to which a second passive element is connectable between the power feeding-side passive element and the first connecting portion of the first element, the third element extends such that the base end thereof is connected via a third connecting portion to which a third passive element is connectable between the power feeding-side passive element and the first connecting portion of the first element, the ground connection pattern is connected to the ground plane and is connected closer to the base end side than the connecting portion between the second element and the third element of the first element via a ground-side passive element, the first element extends with a gap provided between the first element and each of the second element, the third element, and the ground plane such that a stray capacitance is capable of being generated between the first element and each of the second element, the third element, and the ground plane, and at least one of the first element, the second element, and the third element is patterned from the surface to the rear surface of the substrate main body via a through-hole.

In the antenna-device substrate, since the first element extends with a gap provided between the first element and each of the second element, the third element, and the ground plane such that a stray capacitance can be generated between the first element and each of the second element, the third element, and the ground plane, the antenna-device substrate can be provided with a multiple resonance (a double resonance or a triple resonance) characteristic by effectively utilizing a stray capacitance between the antenna element serving as a loading element which is not self-resonant to a desired resonance frequency and each element. By selecting (changing the constant or the like of) the antenna element and the first to third passive elements which are connected to the first to third connecting portions, an antenna device which is capable of flexibly adjusting resonance frequencies and achieving a double resonance or a triple resonance characteristic depending on design conditions can be obtained. As described above, resonance frequencies can be flexibly adjusted by one antenna-device substrate for reasons of antenna configuration, and thus, the resonance frequency can be switched. Consequently, places where adjustment is required by the passive elements or the like can be changed depending on application or equipment. Note that a bandwidth can be adjusted by setting the lengths and widths of the elements and the stray capacitances.

Design can be made within the plane of the substrate main body so that thinning of the substrate main body can be achieved as compared with the case where a conventional dielectric block, molded resin article, or the like is used. In addition, a size reduction and enhanced performance can be achieved by selecting an antenna element serving as a dielectric antenna. Furthermore, no additional cost is incurred due to change in die and design, resulting in realization of a low cost product.

Furthermore, in the antenna-device substrate, since at least one of the first element, the second element, and the third element is patterned from the surface to the rear surface of the substrate main body via a through-hole, such a design of the element which is patterned not only on the surface but also on the rear surface of the substrate main body ensures enhanced performance and size reduction of the antenna without expanding the antenna-occupied area.

Also, an antenna-device substrate according to a second aspect of the present invention is characterized in that, in the first aspect of the present invention, the first element includes a tip loop portion which is formed in a loop shape by a surface linear portion which is patterned on the surface of the substrate main body and a rear surface linear portion that is connected to the surface linear portion via a through-hole and is patterned on the rear surface of the substrate main body with the rear surface linear portion being folded back with respect to the surface linear portion at a position closer to the tip end side than the antenna element.

Specifically, in the antenna-device substrate, since the first element includes a tip loop portion which is formed in a loop shape by a surface linear portion which is patterned on the surface of the substrate main body and a rear surface linear portion that is connected to the surface linear portion via a through-hole and is patterned on the rear surface of the substrate main body with the rear surface linear portion being folded back with respect to the surface linear portion at a position closer to the tip end side than the antenna element, impedance can be lowered as compared with the case where the tip end is opened and a wide bandwidth can be achieved by providing a folded-back section. In addition, since the first element is formed in a loop shape by the utilization of not only the surface but also the rear surface of the substrate main body, a desirable pattern can be formed without interfering with other elements provided on the surface side, resulting in increasing a high degree of freedom in design. Electromagnetic radiation can also be emitted from the rear surface of the substrate main body, resulting in achieving high gain features.

Also, an antenna-device substrate according to a third aspect of the present invention is characterized in that, in the second aspect of the present invention, the first element includes a first extension portion that extends from the feed point in a direction away from the ground plane, a second extension portion that extends from the tip end of the first extension portion in a direction along the ground plane, a third extension portion that extends in a direction along the ground plane and is connected to the antenna element extending in the same direction as the third extension portion where the base end thereof is offset from the tip end of the second extension portion via the first connecting portion in a direction away from the ground plane, a fourth extension portion extending from the tip end of the antenna element toward the ground plane, and a fifth extension portion that extends from the tip end of the fourth extension portion toward the first extension portion along the ground plane on the surface of the substrate main body and comprises a sixth extension portion, of which the base end is connected to the tip end of the fifth extension portion via a through-hole and of which the tip end is connected to the base end of the fourth extension portion via a through-hole, on the rear surface of the substrate main body, the second element extends from the tip end of the second extension portion in the same direction as the second extension portion, and the third element extends in a direction along the ground plane where the base end of the third element is offset from the tip end of the first extension portion via the fourth connecting portion in a direction away from the ground plane.

Specifically, in the antenna-device substrate, since the second element extends from the tip end of the second extension portion in the same direction as the second extension portion and the third element extends in a direction along the ground plane where the base end of the third element is offset from the tip end of the second extension portion via the fourth connecting portion in a direction away from the ground plane, a stray capacitance between the second element and the fifth extension portion, a stray capacitance between the second element and the fourth extension portion, a stray capacitance between the second element and the antenna element, a stray capacitance between the second element and the ground plane, a stray capacitance between the third element and the third extension portion, a stray capacitance between the third element and the second extension portion, and a stray capacitance between the second extension portion and the ground plane can be generated, resulting in obtaining a high degree of freedom in adjustment of resonance frequencies.

Also, an antenna-device substrate according to a fourth aspect of the present invention is characterized in that, in a third aspect of the present invention, the third element includes a surface band-like portion that is patterned on the surface of the substrate main body and a rear surface band-like portion that is connected to the surface band-like portion via a through-hole and is patterned on the rear surface of the substrate main body so as to face the surface band-like portion.

Specifically, in the antenna-device substrate, since the third element includes a surface band-like portion that is patterned on the surface of the substrate main body and a rear surface band-like portion that is connected to the surface band-like portion via a through-hole and is patterned on the rear surface of the substrate main body so as to face the surface band-like portion, the length of the entire third element can be reduced by constituting the surface and the rear surface of the third element with a surface band-like portion and a rear surface band-like portion, respectively. Also, a stray capacitance between the third element and the third extension portion can be adjusted depending on the shape of the rear surface band-like portion. In particular, the impedance produced by the rear surface band-like portion is lowered as compared with that produced by the surface band-like portion by setting the maximum length of the rear surface band-like portion to the length of the surface band-like portion and expanding the width of the rear surface band-like portion to the ground plane side, so that the influence of interference with a resonance frequency associated with the first element is reduced.

Also, an antenna-device substrate according to a fifth aspect of the present invention is characterized in that, in any one of the first to fourth aspect of the present invention, the ground connection pattern includes a fourth passive element that is connected to the tip end side of the power feeding-side passive element of the first element and a fifth passive element that is connected to the base end side of the power feeding-side passive element and an impedance matching circuit is constituted by the power feeding-side passive element, the fourth passive element, and the fifth passive element.

Specifically, in the antenna-device substrate, since the ground connection pattern includes a fourth passive element and a fifth passive element that are connected to both ends of the power feeding-side passive element and an impedance matching circuit is constituted by the power feeding-side passive element, the fourth passive element, and the fifth passive element, resonance frequency fine tuning and impedance adjustment can be performed by setting the power feeding-side passive element, the fourth passive element, and the fifth passive element which constitute so-called a $\pi$(Pi)-type matching circuit even when sufficient impedance adjustment cannot be made only by the setting of the power feeding-side passive element.

Also, an antenna-device substrate according to a sixth aspect of the present invention is characterized in that, in the third or fourth aspect of the present invention, the third extension portion is a wide portion which is formed facing the tip end of the third element such that a stray capacitance can be generated therebetween.

Specifically, in the antenna-device substrate, since the third extension portion is a wide portion which is formed facing the tip end of the third element such that a stray capacitance can be generated therebetween, a stray capacitance between the tip end of the third element and the wide portion can be readily set. In addition, the effective area of the entire antenna increases, resulting in achieving broadband and high gain features.

An antenna device according to a seventh aspect of the present invention is characterized in that the antenna device includes the antenna-device substrate according to any one of the first to sixth aspects of the present invention and the first passive element, the second passive element, and the third passive element are connected to the first connecting portion, the second connecting portion, and the third connecting portion corresponding thereto respectively.

Specifically, in the antenna device, since the first passive element, the second passive element, and the third passive element are connected to the first connecting portion, the second connecting portion, and the third connecting portion corresponding thereto respectively, the antenna device can be provided with a double resonance or triple resonance characteristic by appropriately selecting the first to third passive elements so that communication can be established using two or three resonance frequencies corresponding to each application or each equipment.

Also, an antenna device according to an eighth aspect of the present invention is characterized in that the antenna device includes the antenna-device substrate according to any one of the first to sixth aspects of the present invention and the first passive element is connected to the first connecting portion and either one of the second passive element and the third passive element is connected to the second connecting portion or the third connecting portion corresponding thereto respectively.

Specifically, in the antenna device, since the first passive element is connected to the first connecting portion and either one of the second passive element and the third passive element is connected to the second connecting portion or the third connecting portion corresponding thereto respectively, two types of double resonance can be made without utilizing the second passive element or the third passive element.

Effects of the Invention

According to the present invention, the following effects may be provided.

According to the antenna-device substrate of the present invention and the antenna device provided with the same, since the first element extends with a gap provided between the first element and each of the second element, the third element, and the ground plane such that a stray capacitance can be generated between the first element and each of the second element, the third element, and the ground plane, the antenna-device substrate and the antenna device provided with the same can be provided with a multiple resonance (a double resonance or a triple resonance) characteristic. Also, by selecting the first to third passive elements which are connected to the first to third connecting portions, an antenna device which is capable of flexibly adjusting resonance frequencies and achieving a double resonance or a triple resonance characteristic depending on design conditions can be obtained while ensuring size reduction and enhanced performance. Furthermore, since at least one of the first element, the second element, and the third element is patterned from the surface to the rear surface of the substrate main body via a through-hole, enhanced performance and size reduction of the antenna can be ensured without expanding the antenna-occupied area.

Thus, the antenna-device substrate of the present invention and the antenna device provided with the same can be readily provided with a multiple resonance characteristic corresponding to a wide variety of applications or a wide variety of equipment, resulting in a reduction in space requirements.

BEST MODES FOR CARRYING OUT THE INVENTION

Figure 1:
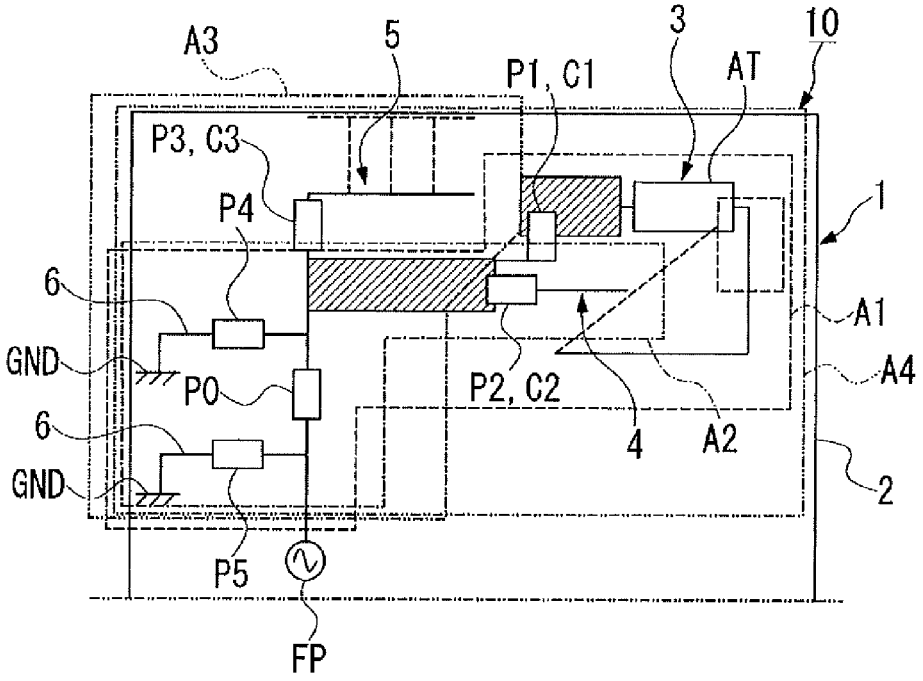
FIG. 1 is a wiring diagram illustrating an antenna-device substrate and an antenna device according to one embodiment of the antenna-device substrate and the antenna device of the present invention.

Hereinafter, a description will be given of an antenna-device substrate and an antenna device provided with the same according to one embodiment of the present invention with reference to FIGS. 1 to 9.

As shown in FIGS. 1 to 4, an antenna-device substrate (1) of the present embodiment includes an insulating substrate main body (2), and a first element (3), a second element (4), a third element (5), a ground plane (GND) and ground connection patterns (6) each of which is in the form of metal foil and has been patterned on the surface of the substrate main body (2).

The substrate main body (2) is a typical printed circuit board. In the present embodiment, the main body of a printed circuit board consisting of a rectangular glass epoxy resin or the like is employed as the substrate main body (2).

Also, the ground plane (GND) with an antenna occupied area is patterned on the rear surface of the substrate main body (2). The ground connection patterns (6) are patterned on the surface of the substrate main body (2) and are formed facing the ground plane (GND) provided on the rear surface of the substrate main body (2) so as to be electrically connected to each other via a through-hole (H). Note that the ground plane (GND) may also be formed on the surface of the substrate main body (2). In this case, the ground connection pattern (6) is directly connected to the ground plane (GND) without the intermediary of the through-hole (H) and is integrally formed with the ground plane (GND).

The first element (3) is provided with the feed point (FP) at the base end and extends while having a power feeding-side passive element (PD), a first connecting portion (C1) to which a first passive element (P1) is connectable, and an antenna element (AT) of a dielectric antenna in this order at the intermediate portion. Note that the feed point (FP) is connected to a high-frequency circuit (not shown) provided on the ground plane (GND) side of the substrate main body (2).

The second element (4) extends such that the base end thereof is connected via a second connecting portion (C2) to which a second passive element (P2) is connectable between the power feeding-side passive element (P0) and the first connecting portion (C1) of the first element (3).

The third element (5) extends such that the base end thereof is connected via a third connecting portion (C3) to which a third passive element (P3) is connectable between the power feeding-side passive element (P0) and the first connecting portion (C1) of the first element (3).

The ground connection pattern (6) is connected to the ground plane (GND) and is connected closer to the base end side than the connecting portion between the second element (4) and the third element (5) of the first element (3) via a ground-side passive element (a fourth passive element (P4) and a fifth passive element (P5)).

At least one of the first element (3), the second element (4), and the third element (5) is patterned from the surface to the rear surface of the substrate main body (2) via the through-hole (H).

The first element (3) includes a first extension portion (E1) that extends from the feed point (FP) in a direction away from the ground plane (GNU), a second extension portion (E2) that extends from the tip end of the first extension portion (E1) in a direction along the ground plane (GND) (which is a direction along which the outer edge of the adjacent ground plane (GND) extends and a direction perpendicular to a direction away from the ground plane (GND)), a third extension portion (E3) that extends in a direction along the ground plane (GND) and is connected to the antenna element (AT) extending in the same direction as the third extension portion (E3) where the base end thereof is offset from the tip end of the second extension portion (E2) via the first connecting portion (C1) in a direction away from the ground plane (GND), a fourth extension portion (E4) extending from the tip end of the antenna element (AT) toward the ground plane (CND), and a fifth extension portion (E5) that extends from the tip end of the fourth extension portion (E4) toward the first extension portion (E1) along the ground plane (GND) on the surface of the substrate main body (2) and includes a sixth extension portion (E6), of which the base end is connected to the tip end of the fifth extension portion (E5) via a through-hole (H) and of which the tip end is connected to the base end of the fourth extension portion (E4) via a through-hole (H), on the rear surface of the substrate main body (2).

The first element (3) includes a tip loop portion which is formed in a loop shape by a surface linear portion which is patterned on the surface of the substrate main body (2) and a rear surface linear portion that is connected to the surface linear portion via a through-hole and is patterned on the rear surface of the substrate main body (2) with the rear surface linear portion being folded back with respect to the surface linear portion at a position closer to the tip end side than the antenna element (AT).

Specifically, the fourth extension portion (E4) and the fifth extension portion (E5) are the surface linear portion and the sixth extension portion (E6) is the rear surface linear portion so that the tip end loop portion is configured in a generally triangle shape with the fourth extension portion (E4), the fifth extension portion (E5), and the sixth extension portion (E6). A connecting section where the fifth extension portion (E5) and the sixth extension portion (E6) are connected is a folded-back section at which the sixth extension portion (E6) is folded at an acute angle relative to the fifth extension portion (E5) via the through-hole (H). Also, the antenna element (AT) and the second element (E7) are patterned so as not to position directly above the sixth extension portion (E6). Specifically, if the sixth extension portion (E6) extends directly beneath the antenna element (AT) and the second element (E7), a bandwidth may be narrowed down due to interference, resulting in a deterioration of antenna performance. Also, even when the sixth extension portion (E6) is arranged along the fourth extension portion (E4) and the fifth extension portion (E5), a bandwidth may be narrowed down due to interference, resulting in a deterioration of antenna performance. Thus, the sixth extension portion (E6) is patterned with a slanted line so as to avoid the antenna element (AT), the second element (4), the fourth extension portion (E4), and the fifth extension portion (E5).

Also, a rear surface wide portion (E6*a*) is patterned at a connecting section where the tip end of the sixth extension portion (E6) is connected with the base end of the fourth extension portion (E4) via the through-hole (H). The rear surface wide portion (E6*a*) is disposed facing the fourth extension portion (E4) and is in a rectangular shape in which the long side of the rear surface wide portion (E6*a*) is arranged along the extending direction of the fourth extension portion (E4). When considering impedance between the fourth extension portion (E4) and the fifth extension portion (E5), the base end side (the antenna element (AT) side) of the fourth extension portion (E4) has the lowest impedance, and thus, the low impedance portion is spread by the rear surface wide portion (E6*a*). Consequently, the influence of interference on the fourth extension portion (E4) and the fifth extension portion (E5) is reduced, resulting in achieving wide bandwidth. Since the rear surface wide portion (E6*a*) is disposed within an open loop formed by the fourth extension portion (E4), the fifth extension portion (E5), and the sixth extension portion (E6), the influence of interference on the rear surface wide portion (E6*a*) is small. Consequently, a pattern design is made such that the rear surface wide portion (E6*a*) extends from the base end side (the antenna element (AT) side) of the fourth extension portion (E4) in the direction toward the tip end thereof.

The second element (4) extends from the tip end of the second extension portion (E2) in the same direction as the second extension portion (E2). Also, the third element (5) extends toward the third extension portion (E3) in a direction along the ground plane (GND) where the base end of the third element (5) is offset from the tip end of the first extension portion (E1) via the third connecting portion (C3) in a direction away from the ground plane (GND).

The third element (5) includes a surface band-like portion (5*a*) that is patterned on the surface of the substrate main body (2) and a rear surface band-like portion (5*b*) that is connected to the surface band-like portion (5*a*) via the through-hole (H) and is patterned on the rear surface of the substrate main body (2) so as to face the surface band-like portion (5*a*).

The ground connection pattern (6) includes a fourth passive element (P4) that is connected to the tip end side of the power feeding-side passive element (P0) of the first element (3) and a fifth passive element (P5) that is connected to the base end side of the power feeding-side passive element (P0) of the first element (3) and an impedance matching circuit is constituted by the power feeding-side passive element (P0), the fourth passive element (P4), and the fifth passive element (P5).

The third extension portion (E3) is a wide portion which is formed facing the tip end of the third element (5) such that a stray capacitance can be generated therebetween. The third extension portion (E3) serving as the wide portion is in a rectangular shape in which the line width is set to be wide as compared with other portions such as the second element (4) and the fifth extension portion (E5). One side of the base end side of the third extension portion (E3) is arranged facing the tip end side of the third element (5). The second extension portion (E2) and the fourth extension portion (E4) are also wide portions.

As described above, the first element (3) extends with a gap provided between the first element (3) and each of the second element (4), the third element (5), and the ground plane (GND) such that a stray capacitance can be generated between the first element (3) and each of the second element (4), the third element (5), and the ground plane (GND).

Figure 6:
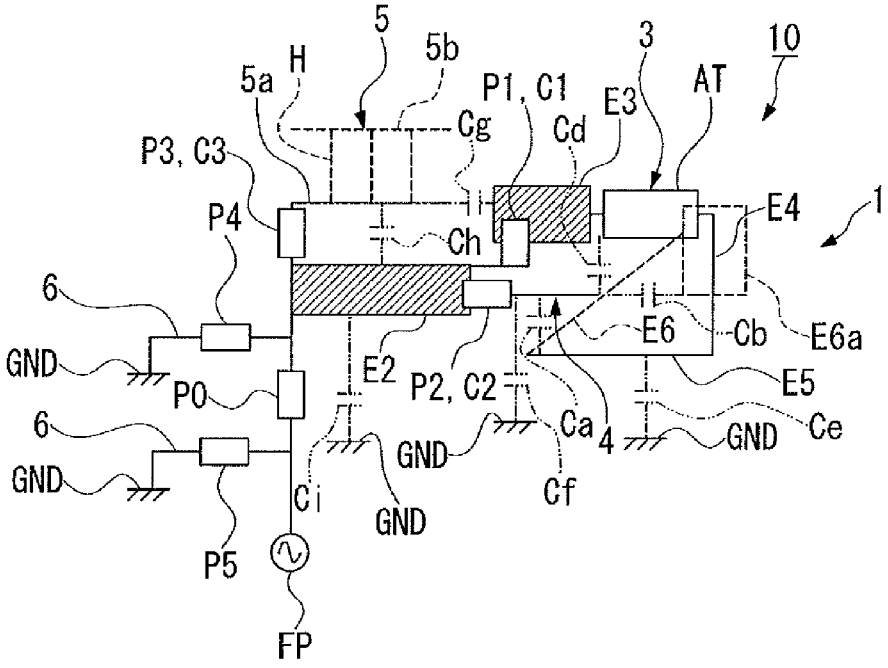
FIG. 6 is a wiring diagram illustrating a stray capacitance generated by an antenna-device substrate and an antenna device according to the present embodiment.

Specifically, as shown in FIG. 6, a stray capacitance (Ca) between the second element (4) and the fifth extension portion (E5), a stray capacitance (Cb) between the second element (4) and the fourth extension portion (E4), a stray capacitance (Cd) between the second element (4) and the antenna element (AT), a stray capacitance (Cf) between the second element (4) and the ground plane (GND), a stray capacitance (Cg) between the third element (5) and the third extension portion (E3), a stray capacitance (Ch) between the third element (5) and the second extension portion (E2), and a stray capacitance (Ci) between the second extension portion (E2) and the ground plane (GND) can be generated.

When the rear surface band-like portion (5*b*) is designed, a stray capacitance is generated between the rear surface band-like portion (5*b*) and the third extension portion (E3) serving as the wide portion. Thus, when the rear surface band-like portion (5*b*) is extended toward the third extension portion (E3), the lowest wideband of the resonance frequency (f1) may be interfered with the rear surface band-like portion (5*b*) depending on the thickness of the substrate main body (2), and thus, such fact has to be taken into consideration. Specifically, the rear surface band-like portion (5*b*) is set to be wide in the direction of the second extension portion (E2) side. Hence, the impedance presented by the rear surface band-like portion (5*b*) is low as compared with that presented by the surface band-like portion (5*a*), resulting in a reduction in the influence of interference. In this case, a stray capacitance between the rear surface band-like portion (5*b*) and the second extension portion (E2) is effectively generated depending on the thickness and dielectric constant of the substrate main body (2). Thus, it is effective to design the rear surface band-like portion (5*b*) that the maximum length of the rear surface band-like portion (5*b*) is set to the length of the surface band-like portion (5*a*) and the width of the rear surface band-like portion (5*b*) is extended toward the second extension portion (E2).

Figure 5:
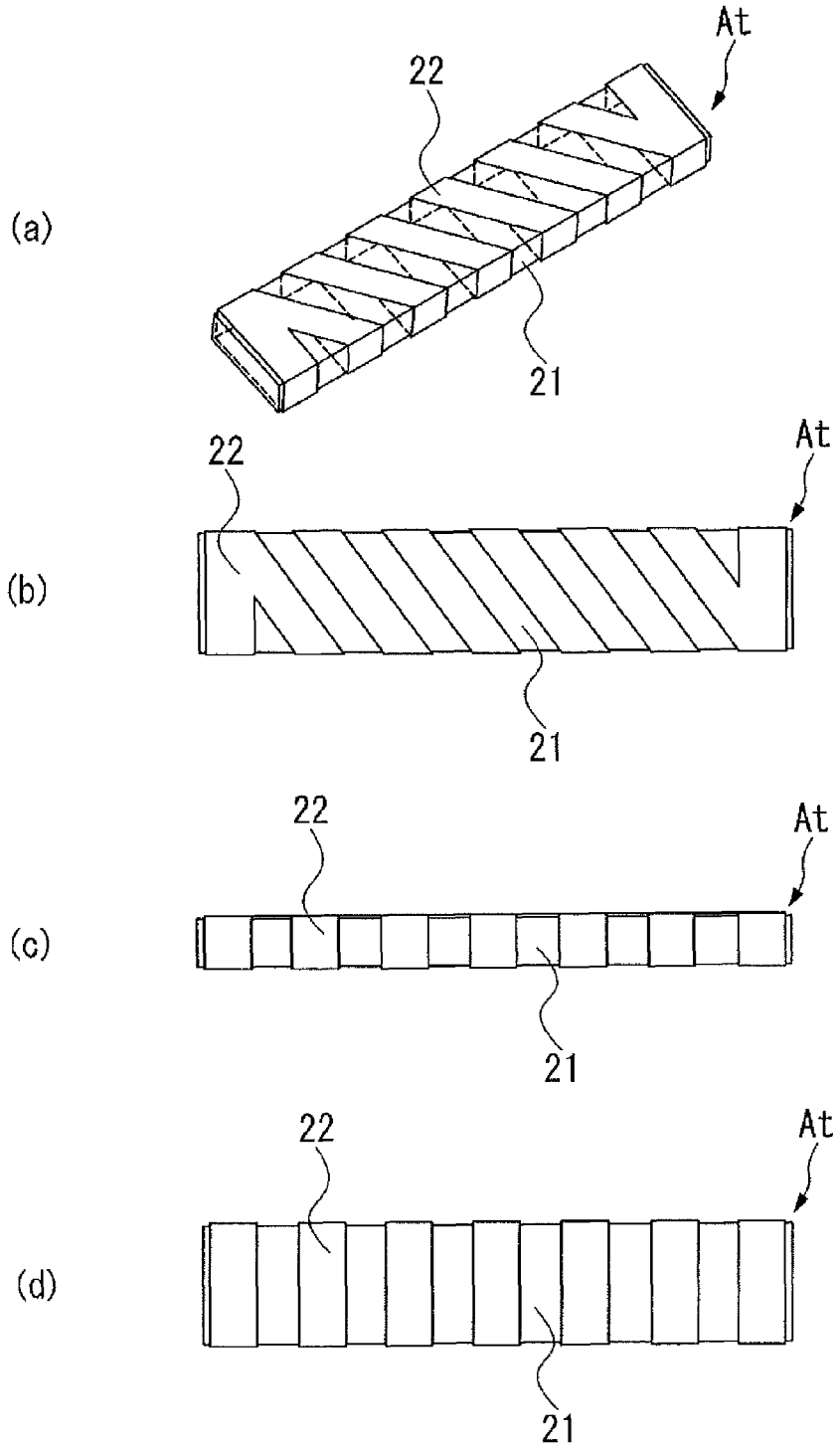
FIG. 5*a* is a perspective view illustrating an antenna element according to the present embodiment.
FIG. 5*b* is a plan view illustrating an antenna element according to the present embodiment.
FIG. 5*c* is a front view illustrating an antenna element according to the present embodiment.
FIG. 5*d* is a bottom view illustrating an antenna element according to the present embodiment.

The antenna element (AT) is a loading element which is not self-resonant to a desired resonance frequency and is, for example as shown in FIG. 5, a chip antenna in which a conductor pattern 22 such as Ag or the like is formed on the surface of a dielectric 21 such as ceramics or the like. For the antenna element (AT), elements having a different length, width, conductor pattern 22, or the like may be selected or the same elements may also be selected depending on the settings of resonance frequency or the like.

As the first passive element (P1), the second passive element (P2), the third passive element (P3), the fourth passive element (P4), and the fifth passive element (P5) and the power feeding-side passive element (P0), an inductor, a capacitor, or a resistor may be employed. It is preferable that the fourth passive element (P4) and the fifth passive element (P5) are passive elements having a different inductor or a different capacitor depending on equipment to be mounted or design conditions.

Figure 2:
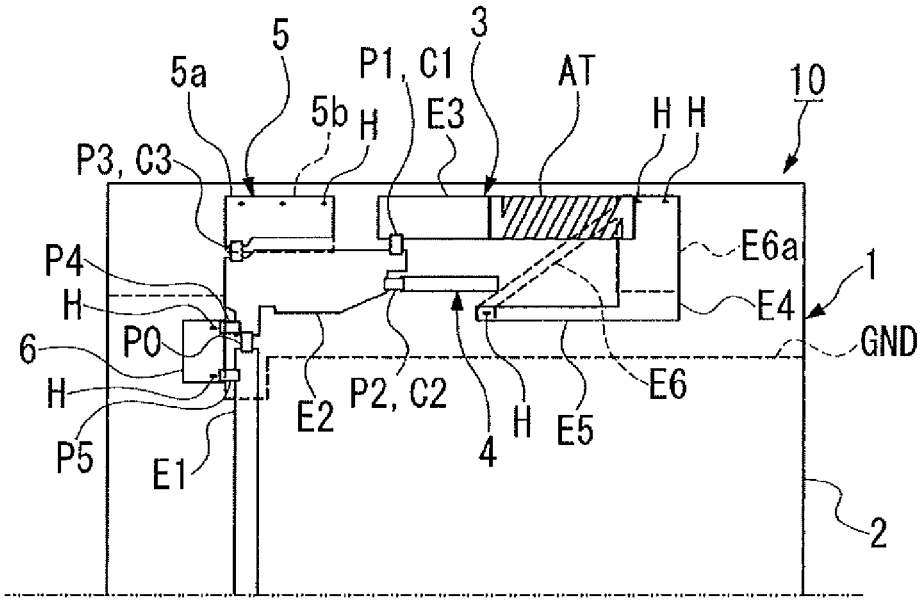
FIG. 2 is a plan view illustrating an antenna device according to the present embodiment.
Figure 3:
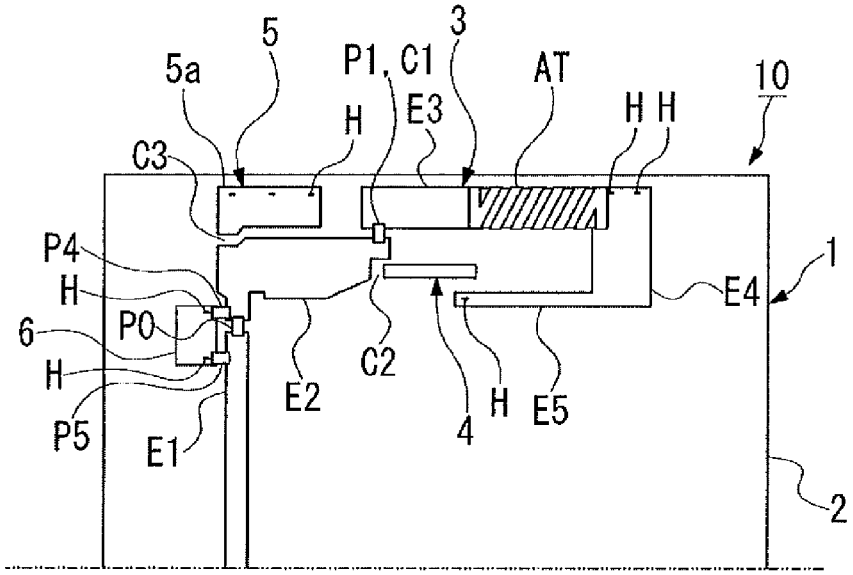
FIG. 3 is a plan view illustrating an antenna-device substrate according to the present embodiment.
Figure 4:
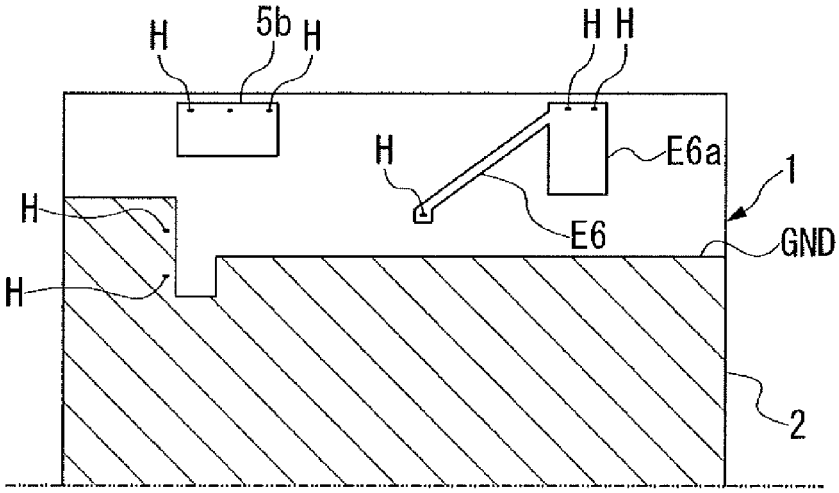
FIG. 4 is a rear view illustrating an antenna-device substrate according to the present embodiment.

As shown in FIG. 1 and FIG. 2, an antenna device (10) of the present embodiment includes the antenna-device substrate (1). The first passive element (P1), the second passive element (P2), and the third passive element (P3) are connected to the first connecting portion (C1), the second connecting portion (C2), and the third connecting portion (C3) corresponding thereto respectively.

It is preferable that the power feeding-side passive element (P0), the fourth passive element (P4), and the fifth passive element (P5), which constitute an impedance matching circuit, are set as follows.

For example, when the fourth passive element (P4) is an inductor and the fifth passive element (P5) is a capacitor, the impedance of the first resonance frequency (f1) and the second resonance frequency (f2) can be adjusted by changing the constant or the like of the fourth passive element (P4) and the impedance of the second resonance frequency (f2) and the third resonance frequency (f3) can be adjusted by changing the constant or the like of the fifth passive element (P5).

Also, when the fourth passive element (P4) is a capacitor and the fifth passive element (P5) is an inductor, the impedance of the second resonance frequency (f2) and the third resonance frequency (f3) can be adjusted by changing the constant or the like of the fourth passive element (P4) and the impedance of the first resonance frequency (f1) and the second resonance frequency (f2) can be adjusted by changing the constant or the like of the fifth passive element (P5).

Note that, when the same passive element is used as the fourth passive element (P4) and the fifth passive element (P5) or when there is only the fourth passive element (P4) or the fifth passive element (P5), all of the first to third resonance frequencies (f1) to (f3) can be adjusted in conjunction with each other.

Next, a description will be given of a resonance frequency in the antenna device of the present embodiment with reference to FIG. 7.

Figure 7:
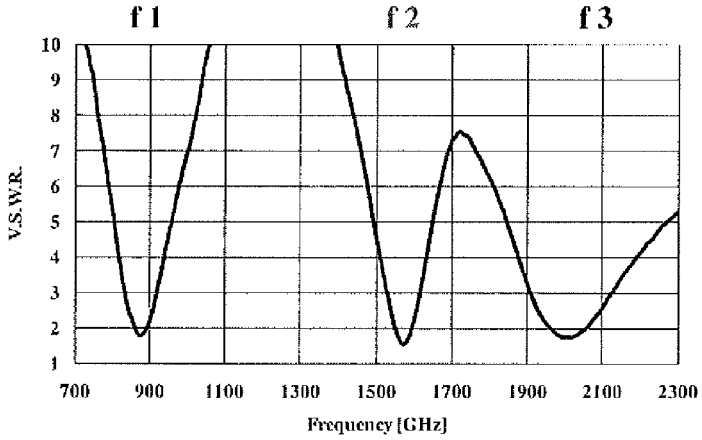
FIG. 7 is a graph illustrating VSWR properties (voltage standing wave ratio) of triple resonance frequencies according to the present embodiment.

As shown in FIG. 7, the antenna device (10) of the present embodiment has multiple resonance frequencies at three frequencies, i.e., a first resonance frequency (f1), a second resonance frequency (f2), and a third resonance frequency (f3).

The first resonance frequency (f1) is in a low frequency band among three resonance frequencies and is determined by the first element (3), the antenna element (AT), the first passive element (P1), the power feeding-side passive element (P0), and the stray capacitance. The second resonance frequency (f2) is in a middle frequency band among three resonance frequencies and is determined by the second element (4), the second passive element (P2), the power feeding-side passive element (P0), and the stray capacitance. Furthermore, the third resonance frequency (f3) is in a high frequency band among three resonance frequencies and is determined by the third element (5), the third passive element (P3), the power feeding-side passive element (P0), and the stray capacitance. For the resonance frequencies, the flow of high-frequency current to the ground plane (GND) side is controlled by using the fourth passive element (P4) and the fifth passive element (P5) so that final impedance adjustment is made.

Hereinafter, a detailed description will be given of these resonance frequencies.

(First Resonance Frequency (f1))

The frequency of the first resonance frequency (f1) can be set and adjusted by the lengths of the second extension portion (E2), the third extension portion (E3), the fourth extension portion (E4), and the fifth extension portion (E5) and the sixth extension portion (E6).

Also, the widening of the first resonance frequency (f1) range can be set by the lengths and widths of the second extension portion (E2), the third extension portion (E3), the fourth extension portion (E4), and the fifth extension portion (E5).

The impedance of the first resonance frequency (f1) can be adjusted by setting stray capacitances that are the stray capacitance (Ca), the stray capacitance (Cb), the stray capacitance (Cd), the stray capacitance (Ce), and the stray capacitance (Ci).

Furthermore, final frequency adjustment can be flexibly made by selecting the first passive element (P1) and the power feeding-side passive element (P0).

Final impedance adjustment can also be flexibly made by selecting the fourth passive element (P4) and the fifth passive element (P5).

As described above, the resonance frequency, the bandwidth, and the impedance thereof can be flexibly adjusted by use of "the lengths and widths of elements", "the passive elements", "the antenna element (AT)", and "the stray capacitance between the elements". Specifically, the first resonance frequency (f1) is mainly adjusted by a portion shown by a broken line A1 in FIG. 1.

(Second Resonance Frequency (f2))

The frequency of the second resonance frequency (f2) can be set and adjusted by the lengths of the second extension portion (E2) and the second element (4).

Also, the widening of the second resonance frequency (f2) range can be set by the lengths and widths of the second extension portion (E2) and the second element (4).

Also, the impedance of the second resonance frequency (f2) can be adjusted by setting stray capacitances that are the stray capacitance (Ca), the stray capacitance (Cb), the stray capacitance (Cd), the stray capacitance (Cf), and the stray capacitance (Ci).

Furthermore, final frequency adjustment can be flexibly made by selecting the second passive element (P2) and the power feeding-side passive element (P0).

Final impedance adjustment can also be flexibly made by selecting the fourth passive element (P4) and the fifth passive element (P5).

As described above, the resonance frequency, the bandwidth, and the impedance thereof can be flexibly adjusted by use of "the lengths and widths of elements", "the passive elements", and "the stray capacitance between the elements". Specifically, the second resonance frequency (f2) is mainly adjusted by a portion encircled by a dot-dash line A2 shown in FIG. 1.

(Third Resonance Frequency (f3))

The frequency of the third resonance frequency (f3) can be set and adjusted by the length of the third element (5) (the surface band-like portion (5*a*) and the rear surface band-like portion (5*b*)).

Also, the widening of the third resonance frequency (13) range can be set by the lengths and widths of the second extension portion (E2) and the second element (4).

Also, the impedance of the third resonance frequency (f3) can be adjusted by setting stray capacitances that are the stray capacitance (Cg), the stray capacitance (Ch), and the stray capacitance (Ci).

Furthermore, final frequency adjustment can be flexibly made by selecting the third passive element (P3) and the power feeding-side passive element (P0).

Final impedance adjustment can also be flexibly made by selecting the fourth passive element (P4) and the fifth passive element (P5).

As described above, the resonance frequency, the bandwidth, and the impedance thereof can be flexibly adjusted by use of "the lengths and widths of elements", "the passive elements", and "the stray capacitance between the elements". Specifically, the third resonance frequency (f3) is mainly adjusted by a portion encircled by a dashed-two dotted line A3 shown in FIG. 1.

It is desirable that the antenna occupied area (the installation area permitted to the antenna device (10)) A4 on the substrate main body (2) be as large as possible in terms of antenna characteristics. It is preferable that the other configurations are set to the following conditions.

Specifically, it is desirable that the distance between the ground plane (GND) and the upper end (the third element (5)) of the antenna-device substrate (1) be set as long as possible in terms of stray capacitance.

It is also desirable that the width of the antenna size (the distance between the base end of the second extension portion (E2) and the outer edge of the fourth extension portion (E4)) be as wide as possible in terms of stray capacitance.

It is also desirable that the distance between the ground plane (GND) and the fifth extension portion (E5) be as long as possible.

For reasons of readily adjustment as a pattern, it is also desirable that the width of the fourth extension portion (E4) be as wide as possible and the length and width of the third extension portion (E3) as the wide portion be as long as and as wide as possible.

It is also desirable that the length and width of the second extension portion (E2) be as long as and as wide as possible.

Note that it is preferable that the size of the substrate main body (2) in a direction along the first extension portion (E1) be a length of about ¼ of the wavelength to be used.

The length of the second element (4) can also be shortened by changing the second element (4) to an antenna element (so-called a chip antenna) of a dielectric antenna that extends in the same direction as the second element (4).

In the antenna device (10) of the present embodiment, a resonance frequency can be switched while taking into account influences around the antenna (antenna peripheral components, human bodies, and the like). Specifically, the adjustment location of the second resonance frequency (f2) and the adjustment location of the third resonance frequency (f3) can be flexibly changed by changing the selection and settings of the antenna element (AT) and the passive elements depending on the application. Specifically, the third resonance frequency (f3) can be adjusted by a portion encircled by the dot-dash line A2 and the second resonance frequency (f2) can also be adjusted by a portion encircled by the dashed-two dotted line A3 by switching the portion encircled by the dot-dash line A2 for adjusting the second resonance frequency (f2) and the portion encircled by the dashed-two dotted line A3 for adjusting the third resonance frequency (f3).

Also, the antenna-device substrate (1) and the antenna device (10) of the present embodiment can be provided with not only a triple resonance described above but also a double resonance. For example, there may be a case where the antenna device (10) of the present embodiment is used for the device of the same type and uses a double resonance at a current stage but uses a triple resonance at a future stage. Even in such a case, the antenna-device substrate (1) can be provided with a double resonance and a triple resonance as it is.

Figure 8:
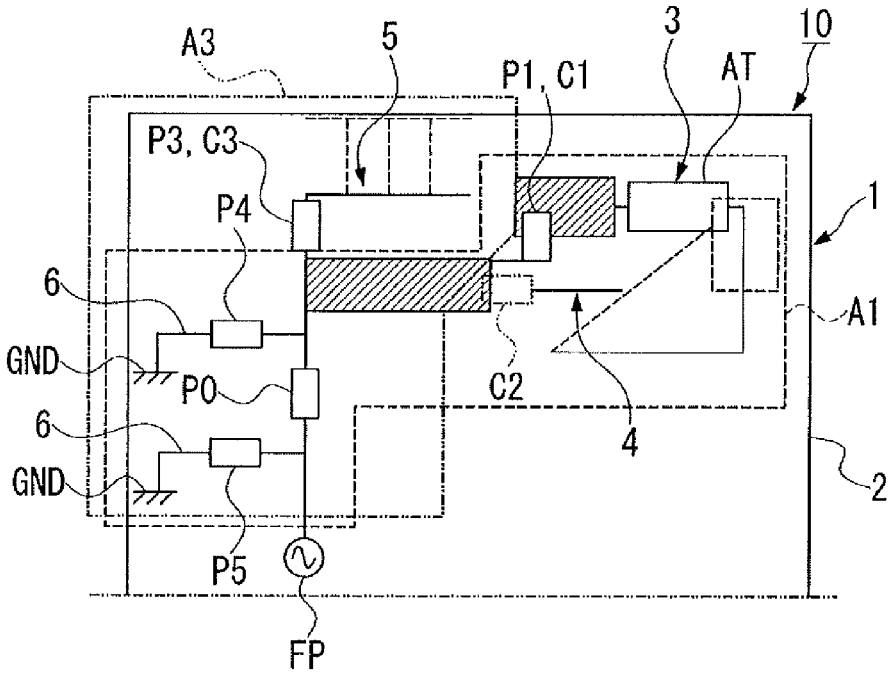
FIG. 8 is a wiring diagram illustrating an antenna device having double resonance frequencies without using a second passive element according to the present embodiment.
Figure 9:
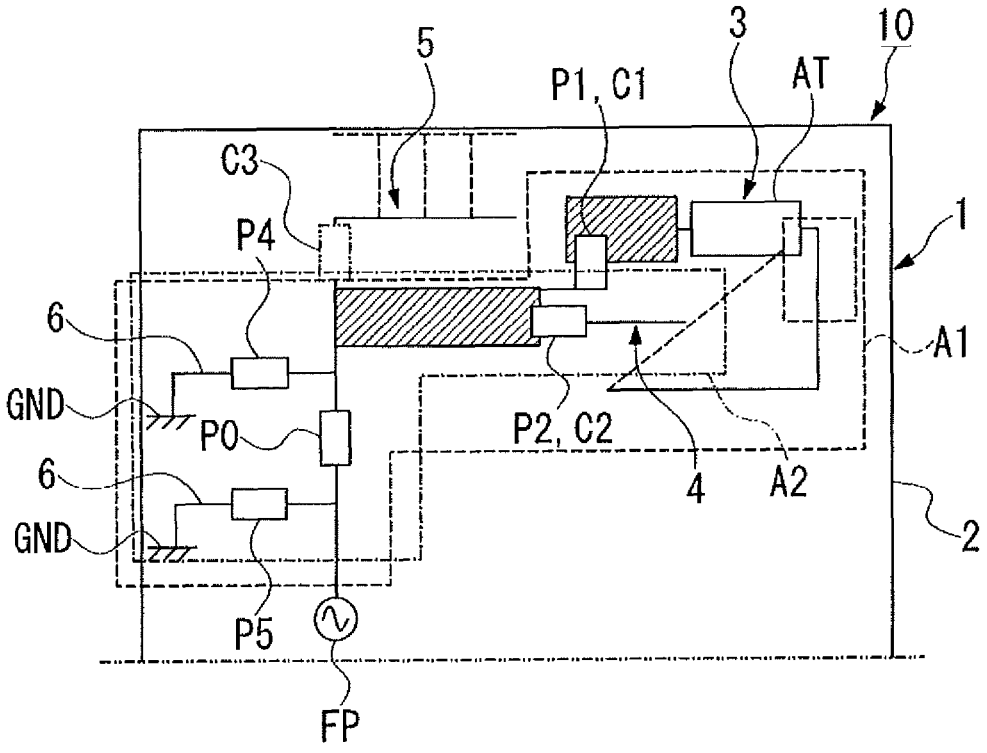
FIG. 9 is a wiring diagram illustrating an antenna device having double resonance frequencies without using a third passive element according to the present embodiment.

As the method for achieving a double resonance, there are two types of corresponding methods: a method for not using the second passive element (P2) as shown in FIG. 8 and a method for not using the third passive element (P3) as shown in FIG. 9. Since the frequency band in this case can be individually adjusted as described above, the frequency band can be flexibly designed to a desired frequency band.

As described above, in the antenna-device substrate (1) and the antenna device (10) of the present embodiment, since the first element (3) extends with a gap provided between the first element (3) and each of the second element (4), the third element (5), and the ground plane (GND) such that a stray capacitance can be generated between the first element (3) and each of the second element (4), the third element (5), and the ground plane (GND), the antenna-device substrate (1) and the antenna device (10) can be provided with a multiple resonance (a double resonance or a triple resonance) characteristic by effectively utilizing a stray capacitance between the antenna element (AT) serving as a loading element which is not self-resonant to a desired resonance frequency and each element.

Also, by selecting (changing the constant thereof or the like) the antenna element (AT), and the first to third passive elements (P1) to (P3) which are connected to the first to third connecting portions (C1) to (C3), the antenna device (10) which is capable of flexibly adjusting resonance frequencies and achieving a double resonance or a triple resonance characteristic depending on design conditions can be obtained. As described above, resonance frequencies can be flexibly adjusted by one antenna-device substrate (1) for reasons of antenna configuration, and thus, the resonance frequency can be switched. Consequently, places where adjustment is required by the passive elements or the like can be changed depending on application or equipment.

Also, design can be made within the plane of the substrate main body (2) so that thinning of the substrate main body (2) can be achieved as compared with the case where a conventional dielectric block, molded resin article, or the like is used. In addition, size reduction and enhanced performance can be achieved by selecting the antenna element (AT) which is a dielectric antenna. Furthermore, no additional cost is incurred due to change in die and design, resulting in realization of a low cost product.

Furthermore, in the antenna-device substrate (1), since at least one of the first element (3), the second element (4), and the third element (5) is patterned from the surface to the rear surface of the substrate main body (2) via the through-hole (H), such a design of the element which is patterned not only on the surface but also on the rear surface of the substrate main body (2) ensures enhanced performance and size reduction of the antenna without expanding the antenna-occupied area.

Since the first element (3) includes a tip loop portion (the fourth extension portion (E4), the fifth extension portion (E5), and the sixth extension portion (E6)) which is formed in a loop shape by a surface linear portion which is patterned on the surface of the substrate main body (2) and a rear surface linear portion that is connected to the surface linear portion via the through-hole (H) and is patterned on the rear surface of the substrate main body (2) with the rear surface linear portion being folded back with respect to the surface linear portion at a position closer to the tip end side than the antenna element (AT), impedance can be lowered as compared with the case where the tip end is opened and a wide bandwidth can be achieved by providing a folded-back section. In addition, since the first element (3) is formed in a loop shape by the utilization of not only the surface but also the rear surface of the substrate main body (2), a desirable pattern can be formed without interfering with other elements provided on the surface side, resulting in increasing a high degree of freedom in design. Electromagnetic radiation can also be emitted from the rear surface of the substrate main body (2), resulting in achieving high gain features.

Furthermore, since the third element (5) includes the surface band-like portion (5*a*) that is patterned on the surface of the substrate main body (2) and the rear surface band-like portion (5*b*) that is connected to the surface band-like portion (5*a*) via the through-hole (H) and is patterned on the rear surface of the substrate main body (2) so as to face the surface band-like portion (5*a*), the length of the entire third element (5) can be reduced by constituting the surface and the rear surface of the third element (5) with the surface band-like portion (5*a*) and the rear surface band-like portion (5*b*), respectively. Also, the stray capacitance (Cg) between the third element (5) and the third extension portion (E3) can be adjusted depending on the shape of the rear surface band-like portion (5*b*). In particular, the impedance produced by the rear surface band-like portion (5*b*) is lowered as compared with that produced by the surface band-like portion (5*a*) by setting the maximum length of the rear surface band-like portion (5*b*) to the length of the surface band-like portion (5*a*) and expanding the width of the rear surface band-like portion (5*b*) to the ground plane (GND) side, so that the influence of interference with a resonance frequency associated with the first element (3) is reduced.

Also, since the ground connection pattern (6) includes the fourth passive element (P4) and the fifth passive element (P5) that are connected to both ends of the power feeding-side passive element (P0) and an impedance matching circuit is constituted by the power feeding-side passive element (P0), the fourth passive element (P4), and the fifth passive element (P5), resonance frequency fine tuning and impedance adjustment can be performed by setting the power feeding-side passive element (P0), the fourth passive element (P4), and the fifth passive element (P5) which constitute so-called a n-type matching circuit even when sufficient impedance adjustment cannot be made only by the setting of the power feeding-side passive element (P0).

Also, since the third extension portion (E3) includes the wide portion which is formed facing the tip end of the third element (5) such that a stray capacitance can be generated therebetween, the stray capacitance (Cg) between the tip end of the third element (5) and the wide portion can be readily set. In addition, the effective area of the entire antenna increases, resulting in achieving broadband and high gain features.

Thus, since the antenna device (10) of the present embodiment includes the antenna-device substrate (1) and the first passive element (P1), the second passive element (P2), and the third passive element (P3) are connected to the first connecting portion (C1), the second connecting portion (C2), and the third connecting portion (C3) corresponding thereto respectively, the antenna device (10) can be provided with a double resonance or triple resonance characteristic by appropriately selecting the first to third passive elements (P1) to (P3) so that communication can be established using two or three resonance frequencies corresponding to each application or each equipment.

Also, since the first passive element (P1) is connected to the first connecting portion (C1), and either one of the second passive element (P2) and the third passive element (P3) is connected to the second connecting portion (C2) or the third connecting portion (C3) corresponding thereto respectively, two types of double resonance can be made without utilizing the second passive element (P2) or the third passive element (P3).

EXAMPLES

Figure 10:
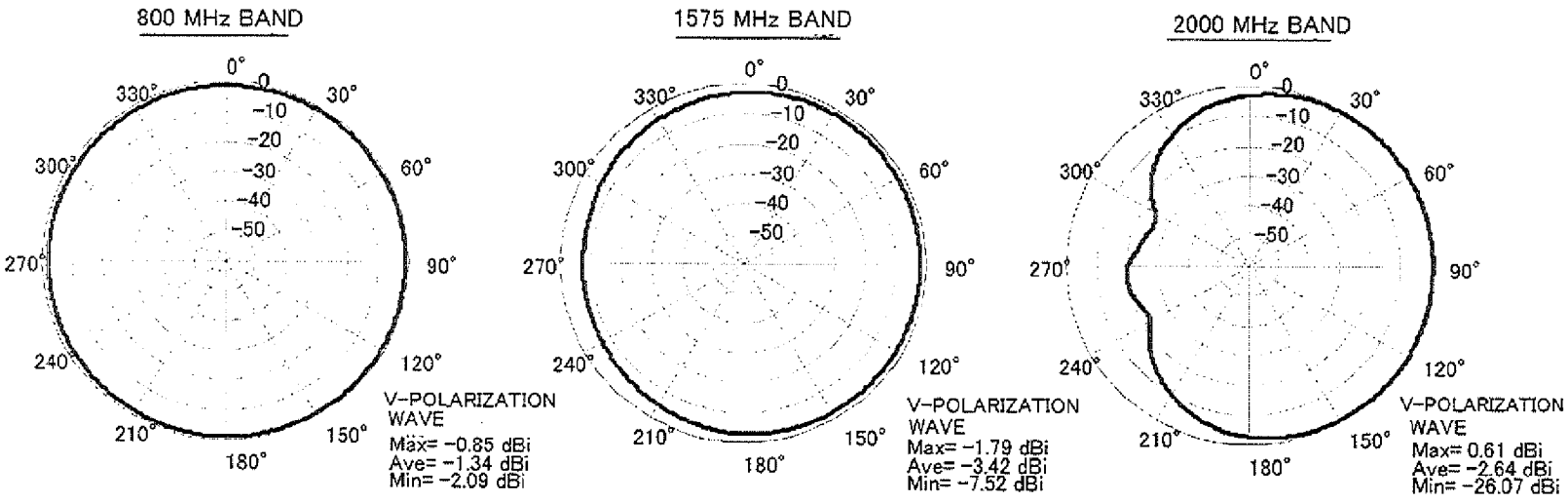
FIG. 10 is a graph illustrating the radiation pattern of an antenna device according to examples of the antenna-device substrate and the antenna device of the present invention.

Next, a description will be given of the results of measurement of a radiation pattern at each resonance frequency using the practically manufactured antenna-device substrate and antenna device provided with the same of the present embodiment with reference to FIG. 10.

Note that the direction along which the first extension portion (E1) extends is defined as the X direction, the direction along which the second extension portion (E2) extends is defined as the Y direction, and the vertical direction to the ground plane (GND) (the vertical direction toward the surface) is defined as the Z direction. A vertical polarization wave to the Y-Z plane in this case was measured.

As the passive elements, a 4.7 nH inductor was used as the first passive element (P1), a 5.6 nH inductor was used as the second passive element (P2), and a 10 nH inductor was used as the third passive element (P3). Also, a 6.8 nH inductor was used as the fourth passive element (P4), a 0.5 pF capacitor was used as the fifth passive element (P5), and a 1.2 nH inductor was used as the power feeding-side passive element (P0).

FIG. 10*a* shows a radiation pattern at the first resonance frequency (f1) of 800 MHz band, where the first resonance frequency (f1) was 871 MHz, the VSWR was 1.71, and the bandwidth (V.S.W.R≤3) was 85 MHz.

Also, FIG. 10*b* shows a radiation pattern at the second resonance frequency (f2) of 1575 MHz band, where the second resonance frequency (f2) was 1569 MHz, the VSWR was 1.57, and the bandwidth (V.S.W.R≤3) was 86 MHz.

Furthermore, FIG. 10*c* shows a radiation pattern at the third resonance frequency (f3) of 2000 MHz band, where the third resonance frequency (f3) was 2005 MHz, the VSWR was 1.72, and the bandwidth (V.S.W.R≤3) was 214 MHz.

As can be seen from these radiation patterns, almost omnidirectional antenna characteristics were obtained for 800 MHz band and 1575 MHz band, whereas antenna characteristics having directionality around 90-degree direction were obtained for 2000 MHz band.

The present invention is not limited to the aforementioned embodiment and various modifications may be made without departing the spirit of the present invention.

While, in the embodiment, one passive element is provided at each connecting portion, the number of passive elements to be provided is not limited to one but may be plural. For example, when fine tuning is further needed for a resonance frequency, two of the first to third passive elements may be provided in series or in parallel.

REFERENCE NUMERALS

1: antenna-device substrate, 2: substrate main body, 3: first element, 4: second element, 5: third element, 5*a*: surface band-like portion, 5*b*: rear surface band-like portion, 6: ground connection pattern, 10: antenna device, AT: antenna element, C1: first connecting portion, C2: second connecting portion, C3: third connecting portion, E1: first extension portion, E2: second extension portion, E3: third extension portion, E4: fourth extension portion, E5: fifth extension portion, E6: sixth extension portion, FP: feed point, OND: ground plane, H: through-hole, P0: power feeding-side passive element, P1: first passive element, P2: second passive element, P3: third passive element, P4: fourth passive element (ground-side passive element), P5: fifth passive element (ground-side passive element)

What is claimed is:

1. An antenna-device substrate comprising:

an insulating substrate main body; and a first element, a second element, a third element, a ground plane, and a ground connection pattern each of which is in the form of metal foil and has been patterned on the substrate main body, wherein the first element is provided with a feed point at the base end and extends while having a power feeding-side passive element, a first connecting portion to which a first passive element is connectable, and an antenna element of a dielectric antenna in this order at the intermediate portion, the second element extends such that the base end thereof is connected via a second connecting portion to which a second passive element is connectable between the power feeding-side passive element and the first connecting portion of the first element, the third element extends such that the base end thereof is connected via a third connecting portion to which a third passive element is connectable between the power feeding-side passive element and the first connecting portion of the first element, the ground connection pattern is connected to the ground plane and is connected closer to the base end side than the connecting portion between the second element and the third element of the first element via a ground-side passive element, the first element extends with a gap provided between the first element and each of the second element, the third element, and the ground plane such that a stray capacitance is capable of being generated between the first element and each of the second element, the third element, and the ground plane, and at least one of the first element, the second element, and the third element is patterned from the surface to the rear surface of the substrate main body via a through-hole.

2. The antenna-device substrate according to claim 1, wherein the first element comprises a tip loop portion which is formed in a loop shape by a surface linear portion which is patterned on the surface of the substrate main body and a rear surface linear portion that is connected to the surface linear portion via a through-hole and is patterned on the rear surface of the substrate main body with the rear surface linear portion being folded back with respect to the surface linear portion at a position closer to the tip end side than the antenna element.

3. The antenna-device substrate according to claim 2, wherein the first element comprises a first extension portion that extends from the feed point in a direction away from the ground plane, a second extension portion that extends from the tip end of the first extension portion in a direction along the ground plane, a third extension portion that extends in a direction along the ground plane and is connected to the antenna element extending in the same direction as the third extension portion where the base end thereof is offset from the tip end of the second extension portion in a direction away from the ground plane via the first connecting portion, a fourth extension portion extending from the tip end of the antenna element toward the ground plane, and a fifth extension portion that extends from the tip end of the fourth extension portion toward the first extension portion along the ground plane on the surface of the substrate main body and comprises a sixth extension portion, of which the base end is connected to the tip end of the fifth extension portion via a through-hole and of which the tip end is connected to the base end of the fourth extension portion via a through-hole, on the rear surface of the substrate main body, the second element extends from the tip end of the second extension portion in the same direction as the second extension portion, and the third element extends in a direction along the ground plane where the base end of the third element is offset from the tip end of the first extension portion via the fourth connecting portion in a direction away from the ground plane.

4. The antenna-device substrate according to claim 3, wherein the third element comprises a surface band-like portion that is patterned on the surface of the substrate main body and a rear surface band-like portion that is connected to the surface band-like portion via a through-hole and is patterned on the rear surface of the substrate main body so as to face the surface band-like portion.

5. The antenna-device substrate according to claim 1, wherein the ground connection pattern comprises a fourth passive element that is connected to the tip end side of the power feeding-side passive element of the first element and a fifth passive element that is connected to the base end side of the power feeding-side passive element of the first element and an impedance matching circuit is constituted by the power feeding-side passive element, the fourth passive element, and the fifth passive element.

6. The antenna-device substrate according to claim 3, wherein the third extension portion is a wide portion which is formed facing the tip end of the third element such that a stray capacitance is capable of being generated therebetween.

7. An antenna device comprising:

the antenna-device substrate according to claim 1, wherein the first passive element, the second passive element, and the third passive element are connected to first connecting portion, the second connecting portion, and the third connecting portion corresponding thereto respectively.

8. An antenna device comprising:

the antenna-device substrate according to claim 1, wherein the first passive element is connected to the first connecting portion, and either one of the second passive element and the third passive element is connected to the second connecting portion or the third connecting portion corresponding thereto respectively.

9. An antenna device comprising:

the antenna-device substrate according to claim 1, wherein the ground connection pattern comprises a fourth passive element that is connected to the tip end side of the power feeding-side passive element of the first element and a fifth passive element that is connected to the base end side of the same and an impedance matching circuit is constituted by the power feeding-side passive element, the fourth passive element, and the fifth passive element, wherein the first passive element, the second passive element, and the third passive element are connected to first connecting portion, the second connecting portion, and the third connecting portion corresponding thereto respectively.

10. An antenna device comprising:

the antenna-device substrate according to claim 1, wherein the ground connection pattern comprises a fourth passive element that is connected to the tip end side of the power feeding-side passive element of the first element and a fifth passive element that is connected to the base end side of the same and an impedance matching circuit is constituted by the power feeding-side passive element, the fourth passive element, and the fifth passive element, wherein the first passive element is connected to the first connecting portion, and either one of the second passive element and the third passive element is connected to the second connecting portion or the third connecting portion corresponding thereto respectively.

11. An antenna device comprising:

the antenna-device substrate according to claim 3, wherein the third extension portion is a wide portion which is formed facing the tip end of the third element such that a stray capacitance is capable of being generated therebetween, wherein the first passive element, the second passive element, and the third passive element are connected to first connecting portion, the second connecting portion, and the third connecting portion corresponding thereto respectively.

12. An antenna device comprising:

the antenna-device substrate according to claim 3, wherein the third extension portion is a wide portion which is formed facing the tip end of the third element such that a stray capacitance is capable of being generated therebetween, wherein the first passive element is connected to the first connecting portion, and either one of the second passive element and the third passive element is connected to the second connecting portion or the third connecting portion corresponding thereto respectively.

13. The antenna-device substrate according to claim 2, wherein the ground connection pattern comprises a fourth passive element that is connected to the tip end side of the power feeding-side passive element of the first element and a fifth passive element that is connected to the base end side of the power feeding-side passive element of the first element and an impedance matching circuit is constituted by the power feeding-side passive element, the fourth passive element, and the fifth passive element.

14. An antenna device comprising:

the antenna-device substrate according to claim 2, wherein the first passive element, the second passive element, and the third passive element are connected to first connecting portion, the second connecting portion, and the third connecting portion corresponding thereto respectively.

15. An antenna device comprising:

the antenna-device substrate according to claim 2, wherein the first passive element is connected to the first connecting portion, and either one of the second passive element and the third passive element is connected to the second connecting portion or the third connecting portion corresponding thereto respectively.

16. An antenna device comprising:

the antenna-device substrate according to claim 2, wherein the ground connection pattern comprises a fourth passive element that is connected to the tip end side of the power feeding-side passive element of the first element and a fifth passive element that is connected to the base end side of the same and an impedance matching circuit is constituted by the power feeding-side passive element, the fourth passive element, and the fifth passive element, wherein the first passive element, the second passive element, and the third passive element are connected to first connecting portion, the second connecting portion, and the third connecting portion corresponding thereto respectively.

17. An antenna device comprising:

the antenna-device substrate according to claim 2, wherein the ground connection pattern comprises a fourth passive element that is connected to the tip end side of the power feeding-side passive element of the first element and a fifth passive element that is connected to the base end side of the same and an impedance matching circuit is constituted by the power feeding-side passive element, the fourth passive element, and the fifth passive element, wherein the first passive element is connected to the first connecting portion, and either one of the second passive element and the third passive element is connected to the second connecting portion or the third connecting portion corresponding thereto respectively.

* * * * *